US009010954B2

(12) United States Patent
Haney et al.

(10) Patent No.: US 9,010,954 B2
(45) Date of Patent: Apr. 21, 2015

(54) GLO-BLADES SKATES

(71) Applicant: Glo-Blades International Inc., Rohnert Park, CA (US)

(72) Inventors: Ralph Haney, Petaluma, CA (US); Zhihong Zhang, Foster City, CA (US)

(73) Assignee: Glo-Blades International Inc., Rohnert Park, CA (US)

( * ) Notice: Subject to any disclaimer, the term of this patent is extended or adjusted under 35 U.S.C. 154(b) by 197 days.

(21) Appl. No.: 13/745,570

(22) Filed: Jan. 18, 2013

(65) Prior Publication Data

US 2013/0221874 A1 Aug. 29, 2013

Related U.S. Application Data

(63) Continuation-in-part of application No. 12/723,955, filed on Mar. 15, 2010, now Pat. No. 8,376,563.

(60) Provisional application No. 61/161,771, filed on Mar. 20, 2009.

(51) Int. Cl.

| | |
|---|---|
| ***A63C 17/26*** | (2006.01) |
| ***A63C 17/06*** | (2006.01) |
| ***A63C 3/00*** | (2006.01) |
| ***H05B 37/02*** | (2006.01) |
| *F21V 33/00* | (2006.01) |

(52) U.S. Cl.

CPC ..... *H05B 37/0272* (2013.01); *F21V 33/0008* (2013.01); *H05B 37/0236* (2013.01); *A63C 3/00* (2013.01); *A63C 17/06* (2013.01); *A63C 17/26* (2013.01); *A63C 2203/14* (2013.01)

(58) Field of Classification Search

CPC ..... F21V 33/0008; H05B 37/0272; H05B 37/0236; A63C 3/00; A63C 17/06; A63C 17/26; A63C 2203/14

USPC ..... 362/103, 190, 191, 249.05, 249.12, 362/276, 394, 395, 802; 36/137; 340/815.45; 280/811

See application file for complete search history.

(56) References Cited

U.S. PATENT DOCUMENTS

| | | | | |
|---|---|---|---|---|
| 5,513,080 | A * | 4/1996 | Magle et al. | 362/103 |
| 5,552,971 | A * | 9/1996 | Madden | 362/459 |
| 7,673,907 | B2 * | 3/2010 | Nenov et al. | 280/811 |
| 7,762,681 | B2 * | 7/2010 | Peckham, Jr. | 362/103 |
| 7,959,314 | B1 * | 6/2011 | Rodriguez | 362/103 |
| 8,203,445 | B2 * | 6/2012 | Recker et al. | 340/531 |
| 2008/0136660 | A1 * | 6/2008 | Bailey | 340/815.45 |
| 2008/0259028 | A1 * | 10/2008 | Teepell et al. | 345/158 |

* cited by examiner

*Primary Examiner* — Alan Cariaso

(74) *Attorney, Agent, or Firm* — Bay Area Technology Law Group PC

(57) ABSTRACT

A plurality of pairs of skates, where each skate has a blade or inline wheels and has a light bar for illuminating a skating surface, are wireless and remotely controlled. A remote controller, which includes an input device, determines the desired illumination characteristics of the pairs of skates and transmits wireless signals indicative of the desired illumination characteristics. Light controllers responsive to the wireless signals cause the desired illumination from the light bars of the skates.

1 Claim, 10 Drawing Sheets

GLO-BLADES SKATES

RELATED APPLICATIONS

This application is a continuation-in-part application of U.S. Ser. No. 12/723,955 filed Mar. 15, 2010, now U.S. Pat. No. 8,376,563, which relies on provisional application U.S. Ser. No. 61/161,771 filed on Mar. 20, 2009.

TECHNICAL FIELD

The present invention involves a device for illuminating the surface beneath ice skates as well as wheeled inline skates to selectively provide the effect of skating on a cloud of light. The device is readily attachable to an existing skate and can thus convert a standard skate to one having increased appeal as the surface upon which the skate travels is illuminated.

BACKGROUND OF THE INVENTION

There have been teachings over time suggesting the benefit of associating a light source with foot wear. Certain athletic shoe manufacturers place a mercury switch in the heel of a shoe to provide a blinking light when pressure is applied to activate the switch. U.S. Pat. No. 5,327,329 teaches a lighting attachment for inline and roller skates in which boxes housing lights are adhered to the sides of skates by means of double sided adhesive tape or by hook and loop fasteners. U.S. Pat. No. 5,552,971 also claims a lighting system for inline skates that employs a spring that may lengthen or shorten automatically when the lighting system is attached to skates of different sizes. U.S. Pat. No. 7,059,739 discloses an illumination device with flashing lights adjustably fixable to ice skates or inline skates in the form of LEDs visible inside of a transparent box installed in the hollow between the shoe portion and blade or wheels of the skate.

In each instance the shoe or skate lights suggested by the patented literature cited above often employ complex assemblies which are not easily applied to the skate or any working parts thereof. Further, the lights tend to be flashing LEDs emanating from the side of the skates which have little or no halo effect upon the ice or skating surface and thus provide little or no visual impact. In addition, all such prior devices require activation and deactivation by requiring a user to bend over and access the device beneath his or her boot or shoe which can be difficult for some users and also can be hazardous in instances where a user might lose one's balance or stop to control the device without regard to other skaters in his or her immediate proximity.

Prior art skates are limited to lights associated with one person. That is, a person controls the lights on his or her skates.

It is thus an object of the present invention to provide a device capable of ready attachment to a preexisting ice or inline skate devoid of the limitations of other devices.

It is yet a further object of the present invention to provide an illumination device for an ice or inline skate which can be releaseably attached to the skate and remotely controlled without the need for activating or deactivating the device at skate level.

It is yet a further object of the present invention to provide an illumination device which is capable of providing a halo effect or light cloud providing an observer with the sense that the user is skating on light thus dramatically enhancing the skating experience.

It is yet a further object of the present invention to provide an illumination device for a plurality of skates networked to one another such that the illumination can be controlled wirelessly and remotely.

It is yet a further object of the present invention to remotely and wirelessly choreograph groups of skaters and the colors projected by their skates.

It is another object of the present invention to remotely and wirelessly synchronize groups of skaters and the light colors from their skate under control of the skaters themselves or by a user remotely located.

Yet another object of the invention is to remotely control and synchronize the colors of objects in addition to the lights projected from light projecting skates.

It is a further object to use music to control the skates lights and pattern of lights.

These and further objects will be more readily apparent when considering the following disclosure and appended claims.

SUMMARY OF THE INVENTION

An illumination device for illuminating a surface being traversed by a skate. The skate is characterized as having a boot, a blade or inline wheels and multiple ribs attaching the boot to the blade or wheels. The device includes a light tube in the form of a plurality of lamps each in electrical contact with a power source. A switch is provided for selectively activating the lamps noting that the light tube is releaseably appended to the boot proximate the ribs whereby the plurality of lamps extend on at least one side of the multiple ribs positioned to illuminate the surface beneath the skate.

Lighted skates are controlled remotely and wirelessly A controller or programmed computer remotely controls the timing, color and sequence of lights of a plurality of skater's skates. This allows the colors and sequencing of skaters to be choreographically synchronized. Further, other items, such as clothes, costumes, and hockey pucks are provided with lights which are also controlled remotely along with the lights from the skaters' skates.

DETAILED DESCRIPTION OF THE INVENTION

Figure 1:
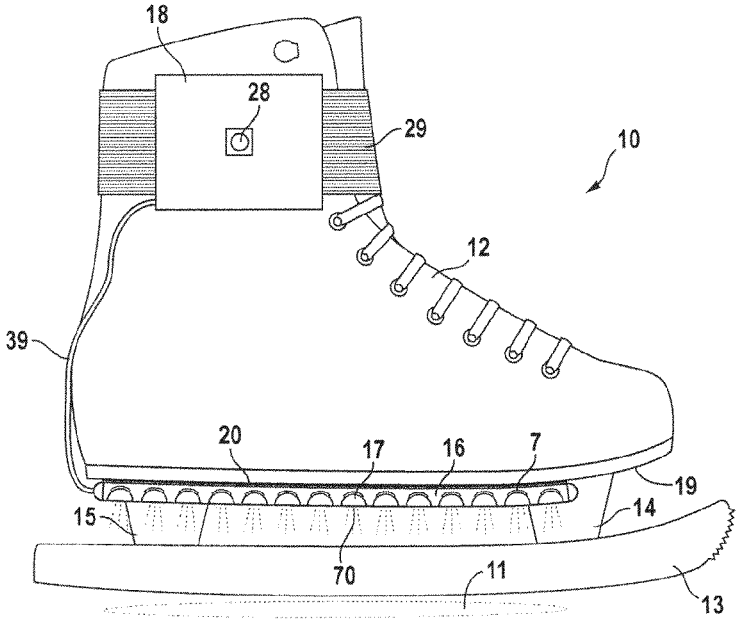
FIG. 1 is a side plan view of a first embodiment of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning to FIG. 1, the first embodiment of the present invention is depicted. Specifically, an illumination device is provided for converting a standard skate 10 into one capable of creating a halo or cloud of light 11 on a surface supporting the skate. FIG. 1 depicts a typical ice skate having boot 12, blade 13 and multiple ribs 14 and 15 used to attach blade 13 to the bottom surface of boot 12.

Figure 5:
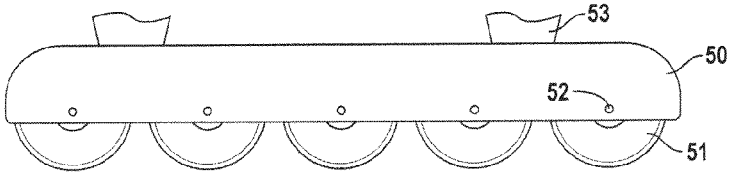
FIG. 5 is a side plan view of a typical inline wheel assembly extendable from a boot for supporting the present invention.
Figure 7:
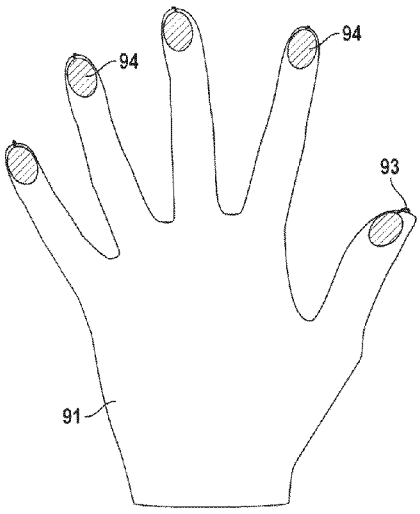
FIGS. 7, 8 and 9 are front, back and side views, respectively, of a further embodiment of a glove used to remotely control the device.

Alternatively, the present invention could be employed with an inline skate, the bottom portion of which being shown in FIG. 5. Specifically, blade 13 would be replaced with assembly 50 housing multiple inline wheels 51 rotating about individual axes 52 and appended to a suitable boot via ribs or other supporting structures 53.

Turning back to FIG. 1, it is noted that, typically, skate 10 includes a plurality of ribs 14 and 15 attached to the bottom surface 19 of boot 10 in order to support blade 13. Skate 10 is converted to one embracing the present invention by mounting light tube 16 comprising a plurality of lamps 17 each in electrical contact with a power source; FIG. 1 depicting, as a preferred embodiment, power source 18, the details of which will be discussed in more detail below.

Light tube 16 is releaseably appended to boot 12 proximate ribs 14 and 15 such that the plurality of lamps 17 extend on at least one side of the ribs and positioned to illuminate a surface creating the halo or cloud of light 11 as shown. In the illustration of FIG. 1, a strip of hook and loop fasteners 20 are adhered to sole portion 19 of boot 12 and a complimentary strip of hook and loop fasteners connected to light tube 16 enabling light tube 16 to be releaseably attached to sole 19 as desired.

Figure 2:
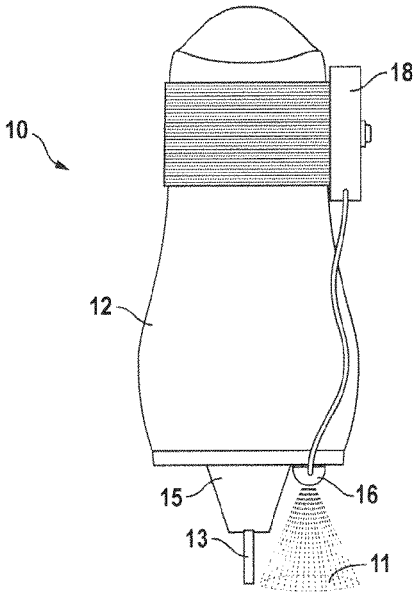
FIG. 2 is a rear view of the embodiment shown in FIG. 1.

It is noted that light tube 16 can be provided on one side of ribs 14 and 15, perhaps best illustrated in FIG. 2. In doing so, the light cloud generated thereby would obviously be created only on a single side of the skate. However, it could be readily apparent to anyone practicing the present invention that a second light tube could be installed on the opposite side of ribs 14 and 15 to illuminate the surface upon which the skate traverses on both sides of and, in fact, the light tube could be completely wrapped about the skate to present a substantially uniform cloud of light surrounding the skate.

Figure 3:
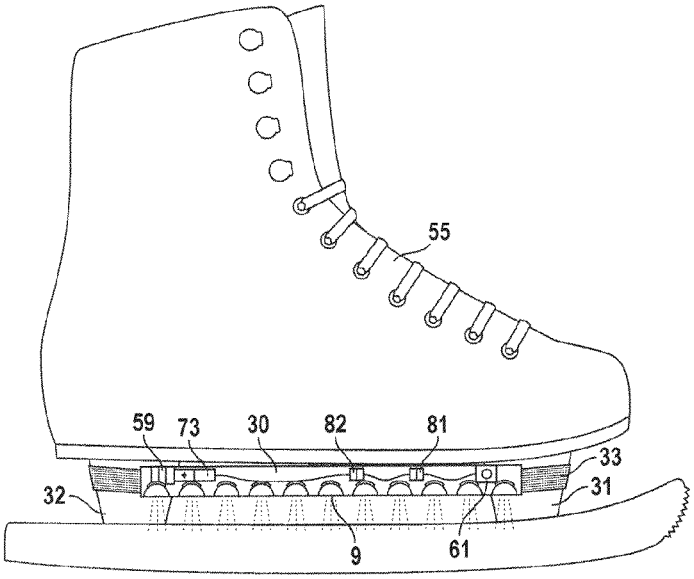
FIGS. 3 and 3*a* are side plan views of yet second and third embodiments of the present invention.
Figure 6:
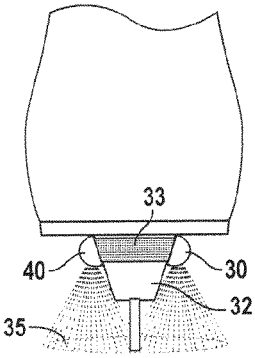
FIG. 6 is a rear view of the embodiment of FIG. 3.

A second embodiment for illustrating the releaseable attachment of lamps below a skate is shown in FIG. 3 in which light tube 30 is appended between and around ribs 31 and 32 by using cord 33 appended to ends of light tube 30. Through the use of this embodiment, any skate could be readily converted to one having the present illumination capabilities without any modification to the skate itself. As noted in FIG. 6, light tube 30, residing on one side of ribs 31 and 32 could be fitted with a companion light tube 40 connected to one another via cord 33 to enable the skating surface to be illuminated on both sides of the skate shown graphically as blanket or cloud of light 35. Cord 33 could be of any suitable structure including stretch cord or wire to enhance the frictional fit of light tubes 30 and 40 about ribs 31 and 32. Ends of cord 33 could be snapped together or, ideally, be fitted with hook and loop fasteners to enhance selective attachment.

As noted previously, and as further illustrated in FIG. 1, the illumination device of the present invention further comprises battery pack 18 as an external power source for light tube 16. Battery pack 18 can be appended to boot 12 shown in the illustration as being appended to the ankle portion of boot 12 through the use of securing band 29, ideally being a loop releaseably attachable through the use of hook and loop fasteners. Lamps 17 within light tube 16 can be powered by battery pack 18 by selectively activating switch 28 thus eliminating the need for one to reach any lower than the ankle portion of the boot. Although not depicted, power source 18 can be located and positioned elsewhere for the convenience of a user recognizing that, in doing so, umbilical 39 making electrical connection between battery 18 and light tube 16 must be accounted for. As a preferred embodiment, battery pack 18 can also include logic circuitry for such features as fading and light sequencing. Battery pack 18 can also contain RF circuitry and portal interfaces for recharging and computer connectivity for programming the logic circuitry.

Further, for the sake of convenience as well as safety, the present invention contemplates, as a preferred embodiment, the use of remote control device 60. This device can be located anywhere that is convenient for a user while being in radio control contact with light tube 30 and particularly control pack 61. Remote control device 60 is intended to include an internal power supply and one or more switches 65, the activation of which is indicated by lamp 64. Switches 65 can include something as simple as an on/off switch or more sophisticated signaling means providing for the selective application of certain lamps or the intermittent activation of lamps to provide a degree of variety to the light illuminated thereby.

Lamps 17 can be one of a variety of light sources including LEDs, incandescents, fluorescents, metal halides and non-burning lasers. As a preferred embodiment, these elements are retained within cover 70 to not only protect the lamps from moisture and debris but also, as a further embodiment, cause light blurring through frosting or refraction to enhance the uniform effect that the individual lamps have upon the skating surface. Cover 70 can also be colored to enhance a spectral output of the light tube.

An important part of the present invention is the creation of cloud of light 11 distinguishing the present invention from prior devices which have LEDs or other discreet light sources emanating directly from the skate's substructure per se. Ideally, lamps 17 are to be directed substantially beneath and surrounding at least a portion of the skate as shown in FIGS. 1 and 2. As further preferred embodiments, light sources 17 can include reflectors 7 to ensure that a substantial portion of the light emanating from light tube 16 is directed to the skating surface proximate blade 13 or inline skate 50.

As preferred embodiments, it is suggested that different lights 17 may point in different directions, or the same direction. The lights may be any types capable of creating the described effect. Some embodiments may include pivoting mounts for the lights, individually and in groups, which may be motorized and controlled via the remote control device 60. The pivoting functionality provides, for example, the ability for the skater to manage the pointing direction and/or automated motion sequences of the light and create patterns and/or random movements in the illumination effect. Various colors of lights are available. For example, the lights may be white, red, orange, yellow, green, blue, or purple. In some embodiments, the lights have different intensities; in other embodiments the lights all have the same intensity.

As an additional embodiment, audio-reactive circuitry can be provided to create pulsing, dynamic effects as the lights' intensities are automatically adjusted and changed in synchronization with the changes in music and/or other audible sounds around the device.

An additional embodiment incorporates a fog and/or mist generation system which produces a visible fog-like cloud, enhancing the lighting effects of the device. This system may produce a definitive trail of plain or colored fog or smoke-like substance around and/or behind the skater. Similar to sky-writing by airplanes, a sufficiently visible trail might exist, the creation and cessation of which may be controlled via an on/off switching function, and also may be available to control via the remote control device. With the smoke-like generation system, a device for emitting sparks out the rear of the unit would be incorporated to provide for an overall visual effect of rocket propulsion and associated exhaust trailing the skater.

An additional feature and/or claim is the enhanced ability for skates to "talk" to each other, at least primitively in the sense that they can affect each other when in close proximity. As an example, a group of young friends are ice skating together in a public skate session (open skating). One skater's light pool is red while all his friends are green. Like the classic children's game of tag, the red skater is "it" and chases after his green friends on the ice. He eventually nears within a couple meters of a green player and suddenly that friend's skates change from green to red, while the former "it" player changes from red to green. The nearby friend is now "it" and proceeds, in turn, to chase the green players. When the new red player comes within a couple meters of a green player their skates will communicate with one another and a color handoff will occur automatically, completing another tag event. Immediately, both players get "Twittered" and/or emailed if Wi-Fi is present in the area in which they're skating.

In various embodiments there may exist a sound generation device, such as one or more speakers or noise generators capable of producing recorded music and/or noises, for example, beeps and sirens. An MP3 processor may be incorporated, either within the illumination device or the remote control device, along with a flash drive port, to provide digital music files available for play. The audio functionality may also be fully controlled by remote control device 60.

Figure 10:
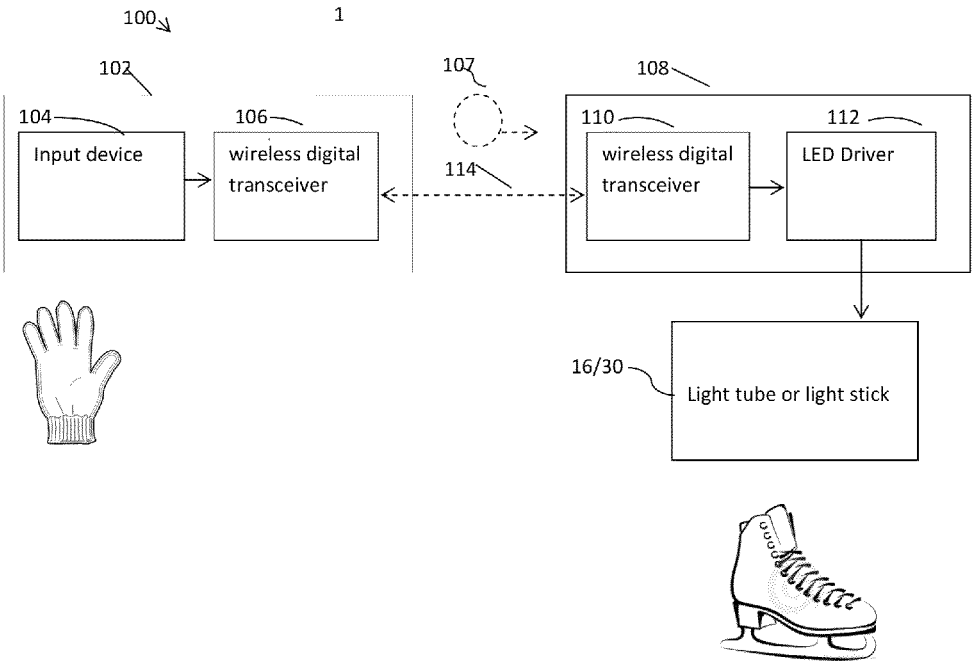
FIG. 10 illustrates a two-way wireless digital communications system for controlling illumination of lighted skates and other objects.

Referring now to FIG. 10, a two-way wireless digital communication lights control system 100 is illustrated for controlling a light tube or light stick comprising, for example, a plurality of LED lights 16/30. Of course other types of lights may be employed but for purposes of the present invention LED lights are described. Control system 100 comprises a remote controller 102 which includes an encoding input device 104 and a wireless digital transceiver 106. Control system 100 also includes a LED controller 108, which in turn includes a wireless digital transceiver 110 and a LED driver 112.

Input device 104 detects input command signals from users and encodes the input command into digital data command signals 107 and then sends the data commands to the wireless digital transceiver 106. Encoding input device 104 can be a touch sensitive device such as glove 91. As explained in more detail later, input device can be remotely located such as a smartphone, DMX, computer, iPad or other device which is linked wirelessly to transceiver 106. Input device 104 detects input commands from users.

As used herein "a user" can mean one or more of the skaters or a person who is remotely situated who is controlling the lighted skates. Such a person might be located, for example, in a control booth at an ice skating arena and is either entering manual commands to, for example, a key board, or wireless commands from, for example, a smart phone. Further, the invention is not limited to real time manual inputs. For example, pre-programed scripts can be used.

The wireless digital transceiver 106 modulates the digital data command signals 107 with radio frequencies and then sends the modulated signal to wireless digital transceiver 110. Examples of radio frequency protocols which can be used include Wi-Fi, Zigbee, Bluetooth and Z-Wave or others. Wireless digital transceivers 106 and 110 can be off the shelf radios such as California Eastern Laboratories (CEL) Mesh Connect EM 357 Mini Modules. For applications such as an ice skating arena the Zigbee protocol can be used, at a frequency of 2.4 GHz, a transmit power of +8 dBm and a sensitivity of −100 dBM. Such a Zigbee protocol can be used, for example, with a DMX light console.

Figure 11:
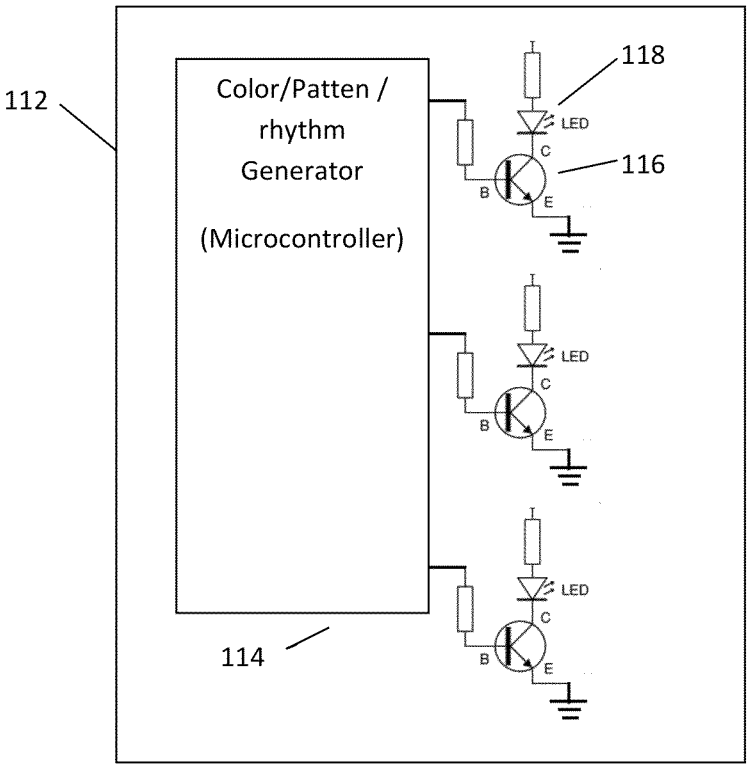
FIG. 11 is a schematic diagram of switching circuit to turn individual lights on and off on the skaters' skates.

The wireless digital transceiver 108 demodulates the digital data command 107 and sends the demodulated signal to the LED driver 112. LED driver 112 comprises an array of electronic switches that are able to turn on or off single or multiple LEDs. The LED driver 112 decodes the digital data command signals 107 and operate the LEDs according to the colors, patterns and sequence dictated by the digital data command signals 107. FIG. 11 illustrates details of an array of switches 116 within LED decoder 112 that turn on or off individual or multiple LEDs 118. When solid state switch 116 is turned on for a particular LED diode 118, the diode emits light.

Figure 12:
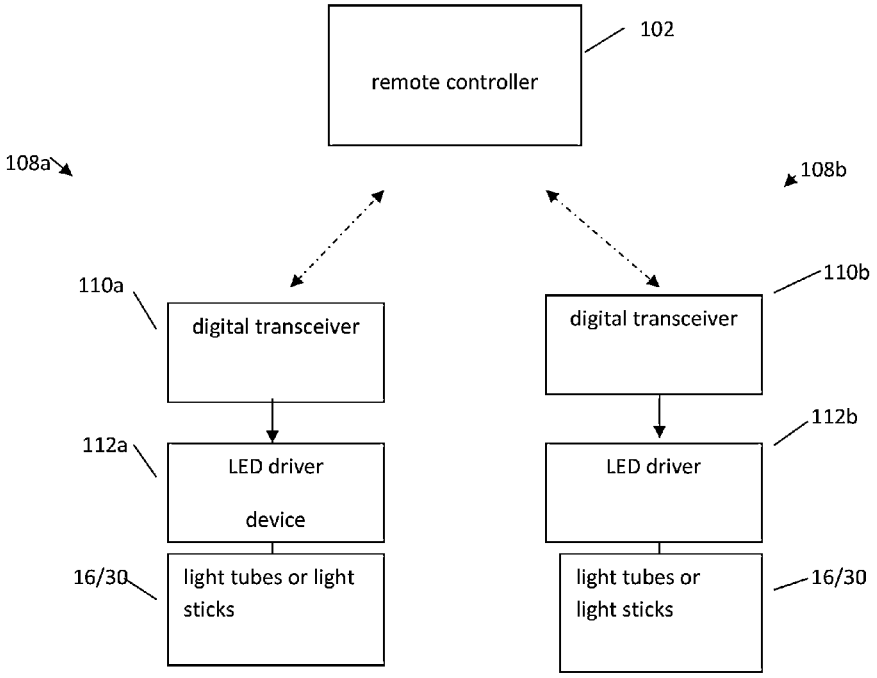
FIG. 12 is a block diagram illustrating how a remote controller controls the lights on individual skaters' skates.

The wireless digital transceivers 106 and 110 are paired with each other based upon unique addresses in order to identify the different skaters. In one embodiment each skater carries one remote controller 102 and two or more LED controllers 108, at least one on each foot, as illustrated in FIG. 12.

Figure 13:
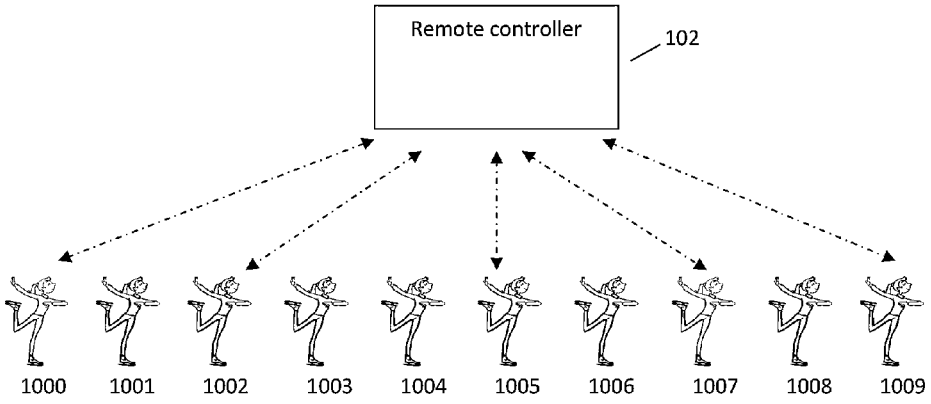
FIG. 13 illustrates an address system for ten skaters

The remote controller 102 has the capability of controlling individual LED controllers 108, sub-groups of LED controllers, or the LED controllers of all of the skaters. This is illustrated in FIG. 13 showing how remote controller 102 interfaces with up to n LED controllers. Each LED controller 108 has a unique address. Where there are ten skaters one user's remote controller 102 can control the illumination of ten users' skates to light individual skates, groups of skates or all the skates with the same or different colors. As explained the user controlling the other skates' lights can be a skater or can be someone who is not on the ice or rink, if indoors, or not a participant skater if outdoors.

Figure 14:
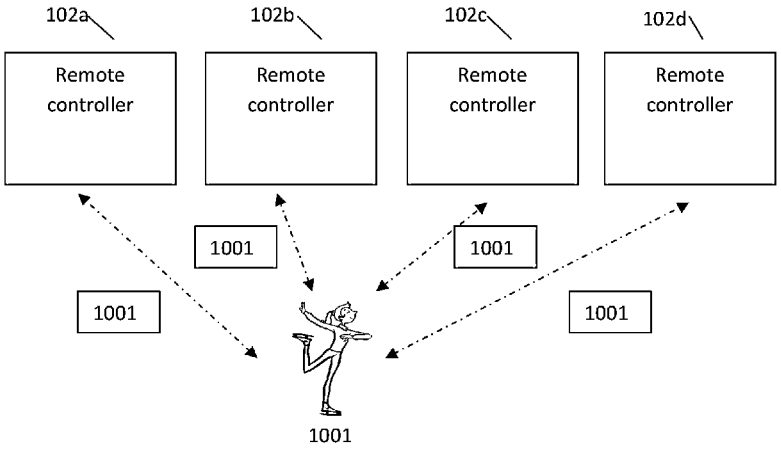
FIG. 14 illustrates how light colors of an individual skater can be remotely controlled by more than one user.

As shown in FIG. 14 the LED controller 108 can be controlled by more than a single remote controller 102. As an example four remote controllers 102 have access to and can control the LED controller 108 of one skater. This is achieved by selecting the address of the wireless digital transceiver 110 for that LED controller. Here the skater has the address 1001. Four other users with remote controllers 102 can change user number 1001 LED's color pattern by addressing the LED controller 102 with that address.

Figure 15:
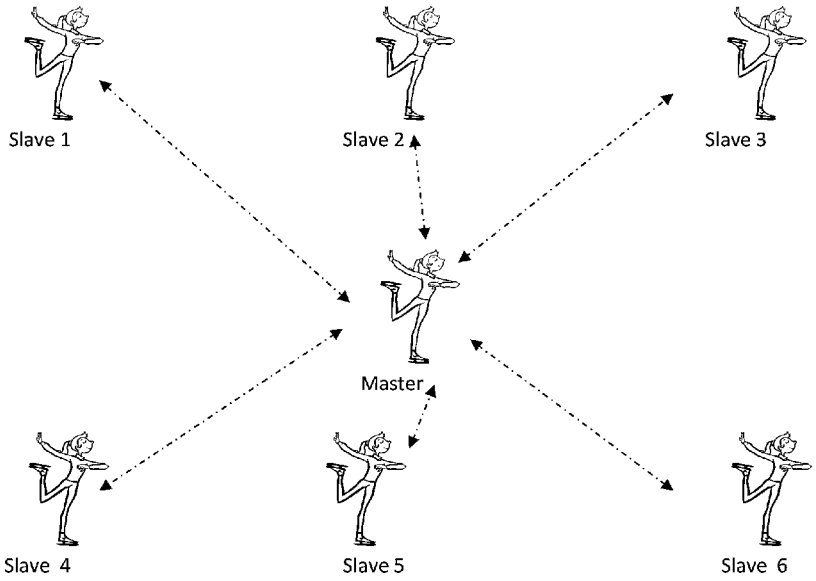
FIG. 15 illustrates how one skater can assume the position of the master and other skaters assume the position of slaves such that all of the slaves lighted skates sync with the master's.

Any user can assume the position of "master" of the other users thereby allowing the "master" to control the other "slave" users. This is illustrated in FIG. 15. For example, remote controller 102 can force other LED controllers 108 so that other user's color bars 16/30 will synchronize with the master's color pattern, colors or sequence of colors at the same time automatically.

Figure 16:
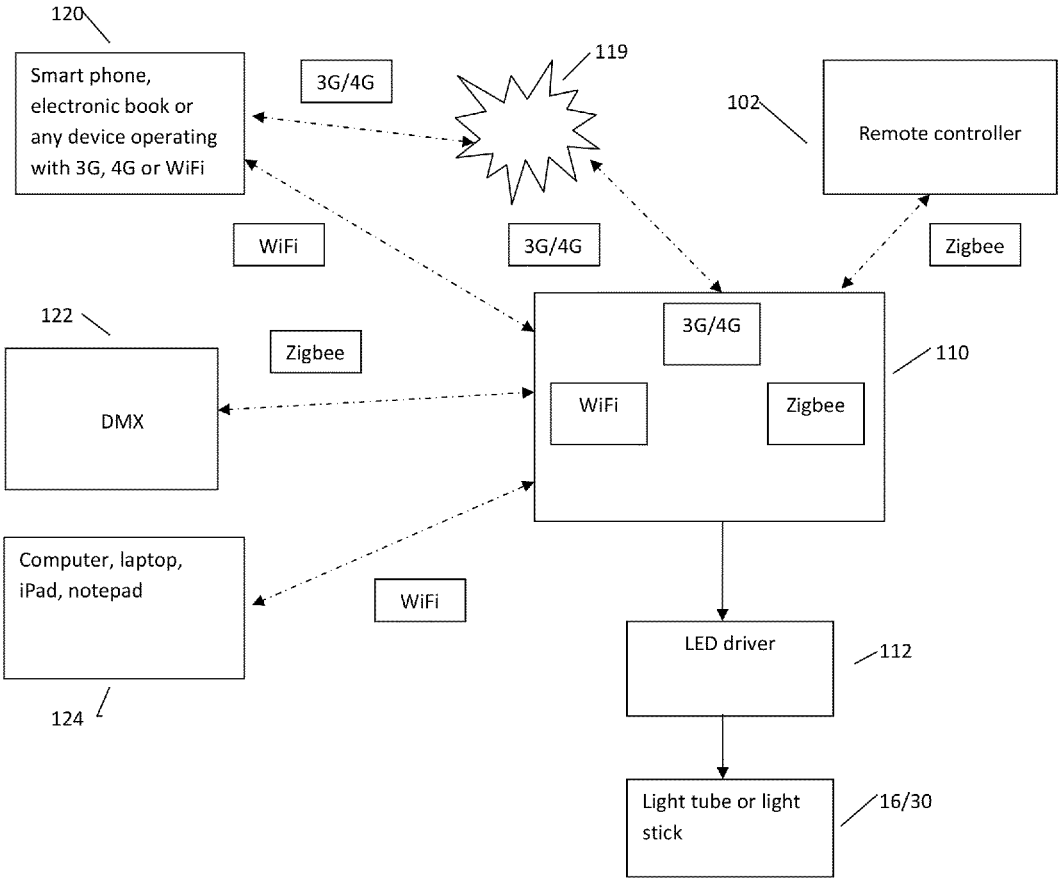
FIG. 16 illustrates various modes and protocols for achieving remote wireless control of the colors skater's lighted skates and other objects.

Wireless remote control is achieved on a large scale and from places remote from the skaters such as a booth at a skating rink, as illustrated by FIG. 16. In accordance with the invention any wireless protocol can be used by transceivers 110. In FIG. 16, as an example, transceiver 110 is provided with a 3G/4G network and Wi-F and Zigbee protocols. As an example smart phone 120 and related devices can transmit commands to transceiver 110 via Wi-Fi and through a 3G/4G network either directly or through the "cloud" computer network 119, such as the internet. Zigbee format is used, as another example, to transmit commands from remote controller 102 and from a lighting console 122 such as a DMX512. Computers, laptops, iPads, notepads and similar devices can communicate wirelessly through Wi-Fi or any other wireless protocol to transceiver 110.

Figure 17:
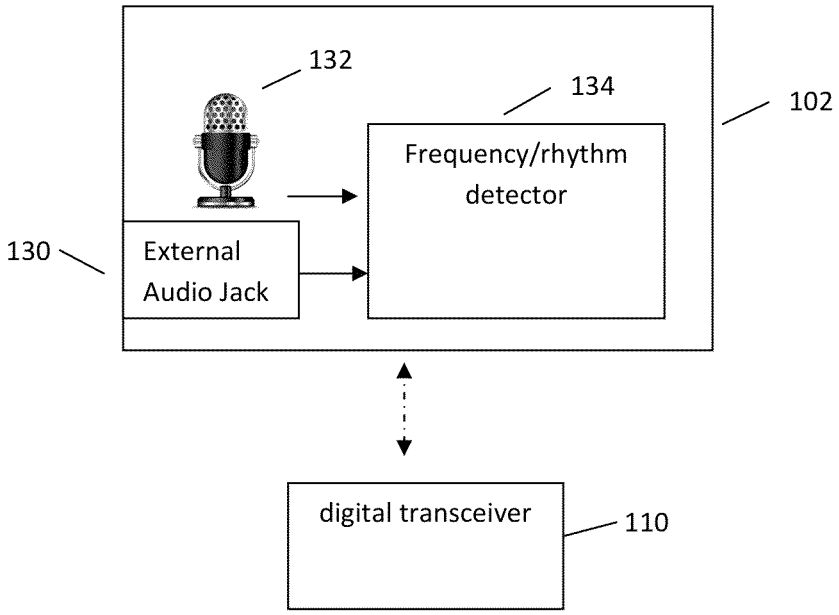
FIG. 17 is a block diagram showing how music can control the illumination patterns of skaters' lighted skates.

As illustrated in FIG. 17, the skaters' lights can be changed reflective of music being played to create unique and changing light patterns. Music is provided, for example, via a microphone 132 or an external audio jack 130. A remote source of music can also be utilized. If the microphone is used, it picks up background music and converts the music into an electronic signal. Based upon the frequency of the background music, the LED array shows different colors. For example, a lower pitch sound could be red and a higher pitch sound could be a blue color. The rhythm of the music could be represented by different patterns of color.

Figure 18A:
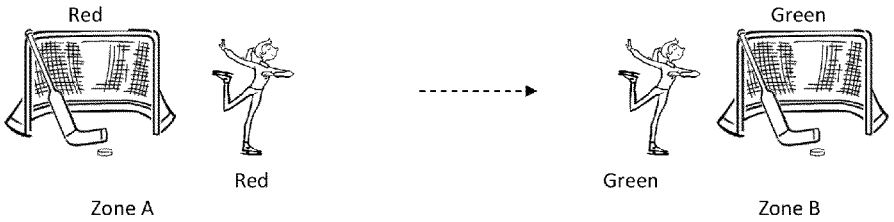
FIG. 18A, FIG. 18B and FIG. 18C illustrates how the position of a skater in a rink or the position of a skater relative to an object in the rink triggers an illumination or change in illumination of lighted skates or other objects.
Figure 18B:
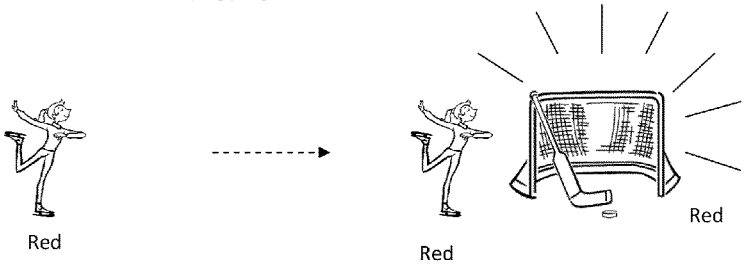
Figure 18C:
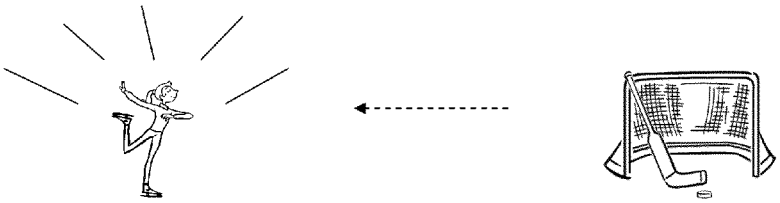

FIGS. 18A, 18B and 18C illustrate another aspect of the present invention. The position of a skater in the rink or the position of a skater relative to an object in the rink triggers an illumination or change in illumination of the lighted skates or other objects. In FIG. 18A when a skater moves from Zone A to Zone B, the lights on the skates change, for example, from red to green. Remote controller 102 senses the location change either by a proximity sensor, a GPS signal or wireless signal strength. Other techniques can also be used to sense the change of location.

Referring now to FIG. 18B, when a skater moves close to a target, in this case a goal, the remote controller 102 senses the location change and sends a message to the target which triggers an illumination event. For example the illumination event can be that the target, the goal, changes color or pattern to match the color of the skater. In FIG. 18C as the skater approaches the goal an illumination event takes place with respect to the skater.

The skater's position in the rink can trigger external events with integrated objects, such as stage lights or sound such as DMX512 controlled objects. So the communication is two-way; skate lights being signaled for events, e.g., changing their color and signaling back to trigger other systems (DMX) via their position in the rink, or entering a sensory triggered area or zone. This is two-way illumination event triggering. An important piece to this is the signal trigger back to the DMX from the skater or sensor, so an external event occurs. Not just the skater changing, but an external event as well based on the zone change or other position change.

The light control system described with respect to FIGS. 10-18 can be used to control illumination of objects other than skates. For example, a hockey puck and any other related sporting gear can be provided with a lighting device so as to be illuminated and remotely controlled. Skaters' clothes are provided with lights so that the light colors thereon are synchronized with the colors of the skates. Other examples include hockey goals, lines and markings on a rink floor below the ice, hockey sticks and props.

An additional feature and/or claim is the enhanced ability for skates to be remotely controlled in groups by computer, perhaps choreographically synchronized. As an example, the team of figure skaters emerges in single file from the black curtain at the end of the rink, entering the ice as the music builds in anticipation. Their skates colors are varied, some blue, some green, others sporting pastels such as aqua and pink, orange, and violet. They circle the ice randomly for a few minutes as the music builds and then suddenly come together, poised in a choreographed stop at center ice—exactly as their skates all change in unison to bright red. Pausing briefly for applause, they begin a choreographed musical program as their light pools change together through various colors and timing suited to the piece. Collectively, their individual skates sequence together with the music, and then at times are purposely unsynchronized to allow for variations and greater creativity within the choreography. Many interesting variations occur, such as subgroups of skaters synchronized together with one color and other subgroups with different colors. A computer program controls the sequencing in time with the music so the skaters are not required to consciously think about the lighting effects. Their skates automatically follow them throughout the performance, creating an incredibly beautiful and memorable experience for the audience and skaters alike.

An additional feature and/or claim is the enhanced ability for the skate's control logic to be modified and/or programmed via an interface to a computer. Using simple software and a connecting cable to a port interfacing with the skate's logic circuitry, the end-user could play/create with various lighting sequences etc.

An additional feature and/or claim is the enhanced ability for the invention to project a logo outline or other shape on the skating surface, as opposed to, or with pools of light. As examples, a Nike® "swish" logo symbol can be projected on the ice or a Chevrolet chevron can be so projected. During the Halloween holidays a jack-o-lantern shape can be projected, during spring a flower shape projected as well as a skater's first name.

Figure 3A:
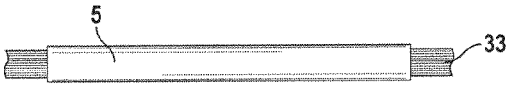
Figure 4:
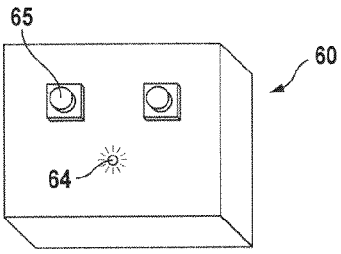
FIG. 4 is a perspective view of a remote control device capable of being used with both embodiments of FIGS. 1 and 2.

In turning to the embodiment of FIG. 3*a*, the invention can include highly miniaturized, self-contained illumination unit (light stick) 5 that requires no external battery pack or power supply cord and that mounts entirely under boot 55 other than associated remote control unit 60.

The light element 30 could include a shell that would house one or more batteries 59, a slim circuit board 73, a plurality of lamps 9, preferably LEDs, various electronic components, one or more control button switches 81 and may contain a motion switch 82. This design could incorporate the same complex logic and functionality as the external battery pack design, compressed into a single streamline shell, including transceiver logic to utilize associated remote control device 60. It, too, could be easily installed via Velcro®-type hook and loop fastener strips or other strips or straps or lengths of material 33 such that mounting hardware is not required, offering extreme portability and ease of use.

Once the device is installed beneath boots 12 or 55, the skater activates light tube 16 or light stick 30 either via button 28 on battery pack 18 or through remote control 60. A plurality of "teamed" colored lights, such as LEDs 17 or 9 mounted within the light stick or tube are controlled via the buttons in such a manner as to provide constant light, alternate colors, flash in sequence, or create other interesting lighting effects. While in operation, creating the effect of "skating on light" can be enhanced by electronic logic circuitry that teams up the same colored LEDs together, thus, for example, providing a light aura of blue, then changeable to green, then red, etc. Logic circuitry can provide the ability for the light arrays to fade out as the next color fades in, providing for interesting secondary colors to exit briefly during the transition from primary colors. The secondary colors may also be maintained for a sustained period of time. Also, the logic allows combinations of different color LEDs, to be activated at the same time, providing a rainbow cloud effect. For example, a red LED could be active at the front of the boot, a yellow LED at the center, and a blue LED at the back. The logic circuitry may also provide an automated sequence of alternating lights through the available colors indefinitely. Furthermore, all colors can be activated at the same time, creating a strong white "wash-out" effect. Many variations, including variations of color and sequence, are available within the circuitry logic, as will be apparent to one of skill in the art upon reading this disclosure.

A primary embodiment of the remote control device is comprised of one or more modified gloves 91 worn by the skater. This remote control design allows the skater to easily control the skate-mounted lights without devoting much conscious thought and attention to the task, a tremendous safety enhancement over non-remote designs. This glove design also does not interfere with the skater using his/her hands to break a fall, a further safety advantage over more traditional hand-held remote devices.

Figure 9:
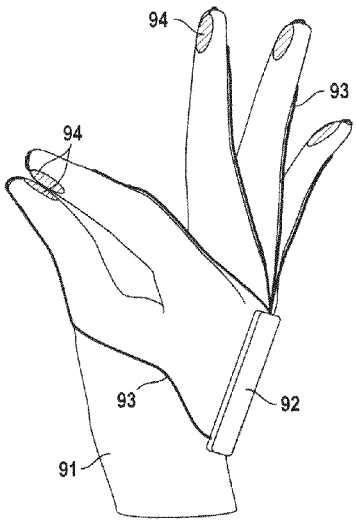

Each glove 91 incorporates transmitter and/or transceiver electronics as explained with respect to FIGS. 10-12, with conductive areas at the fingertips, sides of fingers, and/or other locations to provide switching functionality when one or more areas are pressed together. One embodiment of the glove circuitry provides switching via a common power circuit to the conductive area of the thumb-tip, with ancillary circuits to the finger-tip areas. Thumb-tip and finger-tip areas 94 in this case refer to the anterior areas commonly used for gathering finger and thumb prints. As such, all that is required to close a control circuit, thereby remotely controlling the lights is the pressing together of a finger and thumb, as best illustrated in FIG. 9.

Referring additionally to FIGS. 10-12, glove 91 provides the input command from skaters with lighted skates. Which in turn is converted to a digital data command 107 as explained above. One example of finger combinations that provide ten unique user commands is illustrated in the following table:

| Finger combinations | Index finger | Middle finger | Ring finger | Pinky |
|---|---|---|---|---|
| Thumb + | 1 | 2 | 3 | 4 |
| Thumb + Index finger + | x | 5 | 6 | 7 |
| Thumb + Middle finger + | x | x | 8 | 9 |
| Thumb + Ring finger + | x | x | x | 10 |
| Thumb + Index finger + Middle finger + | x | x | x | 11 |

So for example if the thumb touches the middle finger a "2" command is given. If a thumb touches the middle finger and the ring finger a "6" command is given. If the thumb touches the index finger, the middle finger and the pinky, an "11" command is given. Each command is then converted by the remote controller 102 to order a particular skate light command, such as a particular color for all the skaters, a subgroup of skaters or a single skater.

Figure 8:
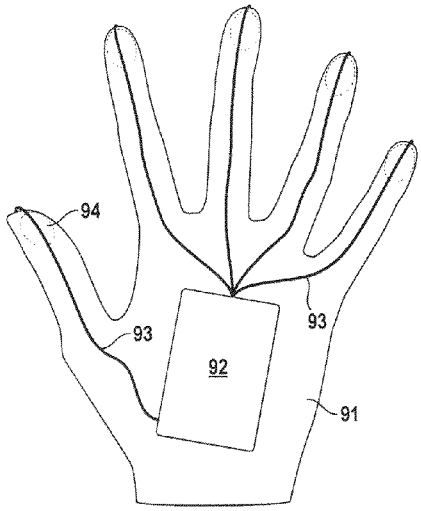

As illustrated in the embodiment in FIG. 8, the control electronics 92 are mounted on the back-hand, posterior area of the glove. Wires, traces, or other conduits 93 provide electrical connectivity to multiple conductive areas. The control electronics 92 are covered or encased for protection. When the common power circuit is closed with a corresponding ancillary circuit one or more switching event(s) occur at the remote receiver control pack via wireless signal. Additional embodiments may utilize standard electronic switches instead of, or with, conductive areas for control of switching events.

One advantage of this design over prior lighted skate designs is its simplicity and ease of use. Another advantage is in the use of remote control unit 60 with full functionality. Yet another advantage is that unlike U.S. Pat. No. 7,059,739, and similar light skate patents, which incorporate complexity via mechanical mounting approaches and a large number of parts, many embodiments of the designs herein provide for extremely easy mounting to any model of skate, allowing for easy removal and switching between skates. This results in the reduced likelihood of problems (e.g. mechanical failure) due to its inherent simplicity. Additionally, the use of remote control device 60 provides for greater safety, reducing the need to reach down to the skate area to facilitate control of the lighting effects. Another advantage is the relatively low cost of manufacturing, allowing the cost of production to remain low and within reach of younger consumers. The overall intent of this design is to provide a low cost, extremely easy way to add a "WOW!" factor to skates that is easily removable, safer to operate (especially for children), and stable in its simplicity and operation. This self-contained module design coupled with remote control and motion-activated operation attains this goal uniquely.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like.

Therefore, the above description and illustration should not be considered as limiting the scope of the invention, which is defined by the appended claims.

What is claimed is:

1. A wirelessly controlled illumination device under the command of one or more users comprising:

a plurality of pairs of skates, each skate having a blade or inline wheels and having one or more light bars or tubes for illuminating a skating surface;

a remote controller for determining desired illumination characteristics of the light bar or tubes and for transmitting wireless signals indicative of the desired illumination characteristics;

light controllers responsive to the wireless signals to effect the desired illumination from the light bars of the plurality of pairs of skates, and wherein each remote controller includes an input device and a wireless digital transceiver, and wherein the input device detects commands from users and encodes the input commands into digital data command signals and wherein the wireless digital transceiver wirelessly transmits the digital data command signals, and wherein each remote controller includes a wireless digital transceiver and light driver, wherein the wireless digital transceiver wirelessly receives and decodes the digital data command signals and wherein the light driver controls the illumination of the light bars or tubes of the plurality of skates according to the decoded digital command signals, and wherein the input device is a touch sensitive device in the form of a glove with conductive areas on each finger.

* * * * *